US006539767B2

(12) United States Patent
McClung

(10) Patent No.: US 6,539,767 B2
(45) Date of Patent: Apr. 1, 2003

(54) METHOD AND APPARATUS FOR FORMING A CONTAINER COMPONENT

(75) Inventor: James A. McClung, N. Canton, OH (US)

(73) Assignee: Sequa Can Machinery, Inc., Canton, OH (US)

( * ) Notice: Subject to any disclaimer, the term of this patent is extended or adjusted under 35 U.S.C. 154(b) by 0 days.

(21) Appl. No.: 09/894,955

(22) Filed: Jun. 28, 2001

(65) Prior Publication Data

US 2002/0023474 A1 Feb. 28, 2002

Related U.S. Application Data

(60) Provisional application No. 60/229,232, filed on Aug. 31, 2000.

(51) Int. Cl.[7] ..... B21D 22/22
(52) U.S. Cl. ..... 72/336; 72/348
(58) Field of Search ..... 72/329, 336, 348

(56) References Cited

U.S. PATENT DOCUMENTS 822,233 A * 6/1906 Alston ..... 72/336
1,984,774 A * 12/1934 Stogner, Sr. ..... 72/336
3,704,618 A * 12/1972 Cvacho et al. ..... 72/336
4,587,826 A * 5/1986 Bulso, Jr. et al. ..... 72/36
4,903,521 A 2/1990 Bulso, Jr. et al.
4,977,772 A 12/1990 Bulso, Jr. et al.
5,626,048 A 5/1997 McClung
5,881,593 A 3/1999 Bulso, Jr. et al.

* cited by examiner

*Primary Examiner*—Lowell A. Larson
(74) *Attorney, Agent, or Firm*—Sand & Sebolt

(57) ABSTRACT

A method and apparatus for forming a container component has a fixed stock plate and cut edge mounted on a base at a first level for forming a disk-shaped blank from a strip of sheet material. A blank and draw die is mounted at a second level which forms the disk-shaped blank into a shallow cup upon advancement of a punch assembly through the die. A profile pad is mounted at a third level on the base and imparts a profile on the bottom wall of the shallow cup as the punch assembly continues a downward stroke. An air stream ejects the profiled container component from the press at the third level.

17 Claims, 12 Drawing Sheets

METHOD AND APPARATUS FOR FORMING A CONTAINER COMPONENT

CROSS REFERENCE TO RELATED APPLICATIONS

The present application is based on U.S. Provisional Application Serial No. 60/229,232 filed Aug. 31, 2000.

BACKGROUND OF THE INVENTION

1. Technical Field

The invention relates to forming components for use in containers such as the container body and/or the end shell for use as a closure end for the container body from a blank of metal in a press. More particularly, the invention relates to a method and apparatus in which the operations are formed at three distinct levels in the press, and in which the press has a fixed stock plate to provide for higher speeds to increase the output production of the press.

2. Background Information

It is well known in the container forming art to form two piece containers, that is, containers in which the container bodies are one-piece members and the end closure or shell is a separate piece. These component pieces are formed by initially stamping disk-shaped blanks from a strip of sheet metal material and then subsequently drawing the blank into a cylindrical cup-shaped member and then profiling the bottom wall. The can body or shell is then ejected from the press for subsequent forming and/or end curling at a separate station. Speed of press operation and the number of first stage can bodies and/or end shells is critical with higher production speed being of critical importance.

One of the factors which limits the speed of the press is the scrap web or matrix which results when a plurality of the blanks are cut from the strip of sheet metal at each press stroke. This scrap web limits the speed of the press since the stock plate on which it initially rests is resiliently mounted and moves downwardly during each of the blanking operations and then returns to the input level before the sheet material moves linearly for the next press stroke. Another factor which effects the speed of operation is the profiling of the bottom wall of the cup-shaped member whether it be a container body or an end shell.

The closest prior art to the subject invention is believed shown in U.S. Pat. Nos. 4,903,521; 4,977,772 and 5,881,593. These three patents show the formation of container components including the container body and the end shells, in a high speed press wherein the formed blank is passed through the blank and draw die to a lower level for profiling of the bottom wall, afterwhich it is ejected from the press at or near the profiling level. However, these presses all have a resiliently mounted stock plate which is depressed when cutting the disk-shaped blank from the sheet material requiring return of the scrap web and connected sheet material back to the beginning level prior to the sheet material being moved linearly into the press for the next press cycle or ram stroke. Although this reciprocal movement of the web and sheet material takes a very short period of time, it becomes critical when the speed of these presses is generally within the range of between 300 and 700 strokes per minute. Thus, the saving of a fraction of a second during each press stroke amounts to a considerable increase in production over an extended period of time.

Likewise, the scrap web being continually moved upwardly and downwardly during each stroke as the strip material moves through the press occasionally will cause press jamming requiring stopping of the press and removal of the scrap material therefrom.

Therefore, the need exists for a modified press and unique tooling therefore which increases production by eliminating reciprocal movement of the sheet material and scrap web during each stroke and which improves the speed of profiling the bottom of the preformed container component.

SUMMARY OF THE INVENTION

Objectives of the invention include providing an improved apparatus and method for forming container components, such as the cup-shaped container bodies and/or the end shells therefore, preferably in a double action press from sheet metal material wherein the material is blanked at a first level, drawn into a generally cylindrical cup-shaped blank at a second level by a blank and draw die, and then moved through the die by the continued single stroke of the press to a third level whereat the bottom of the cup-shaped blank is profiled, afterwhich it is ejected from the press at the third level.

Another feature of the invention is to provide such an improved press and method in which the sheet material is fed into the press at a first level on a fixed stock plate where it is blanked into one or a plurality of disk blanks, which disk blanks are clamped against the top surface of the blank and draw die at a second level, where they are drawn into the shallow cup-shaped configuration by the continued downward stroke of the draw pad.

A further objective of the invention is to provide such a method and apparatus in which the bottom profile pad is cam actuated and moves upwardly into engagement with the bottom panel of the cup-shaped blank for profiling the cup at the third level into a can body or end shell, afterwhich the profile pad is withdrawn and the container component ejected from the press at the third level by pressurized air.

A further objective of the invention is to fixedly mount the bottom profile pad at the third level surrounded by a movable knockout ring, which moves the bottom profiled cup-shaped blank to the third level for subsequent discharge from the press after profiling the bottom wall of the previously formed shallow cup.

These features and objectives of the invention are obtained by the improved method of forming a container component from a strip of metal material fed into the press, the general nature of which may be stated as including the steps of providing the press with a fixed stock plate; feeding the strip material onto the fixed stock plate of the press at a first level; cutting a blank from the strip material at said first level; clamping the blank against a blank and draw die at a second level; forming a shallow cup from the blank by advancing a punch assembly beyond the second level toward a third level; profiling a bottom wall of the cup adjacent a third level to form the container component by continuing to advance the punch assembly through the die to the third level; and removing the container component from the press at the third level.

The objectives of the invention are further obtained by the improved apparatus of the present invention, the general nature of which may be stated as including a base; a stock plate immovably mounted on the base and defining a first level; a cut edge carried by the base at said first level; a reciprocally mounted blank and draw die having a top clamping surface defining a second level mounted on the base; a discharge opening defining a third level below the clamping surface of the die; a profile pad mounted on the base having a top profile surface generally adjacent with the third level; a draw pad ring reciprocally mounted for clamping the blank disk against the clamping surface of the die; a draw punch reciprocally movably mounted within the draw pad ring for moving the blank disk through the die to form a shallow cup-shaped blank and into forming engagement with the profile pad to form the container component in a single stroke.

BRIEF DESCRIPTION OF THE DRAWINGS

Preferred embodiments of the invention, illustrative of the best modes in which applicant contemplates applying the principles of the invention, are set forth in the following description and are shown in the drawings and are particularly and distictly pointed out and set forth in the appended claims.

Similar numerals refer to similar parts throughout the drawings.

DESCRIPTION OF THE PREFERRED EMBODIMENTS

Figure 1:
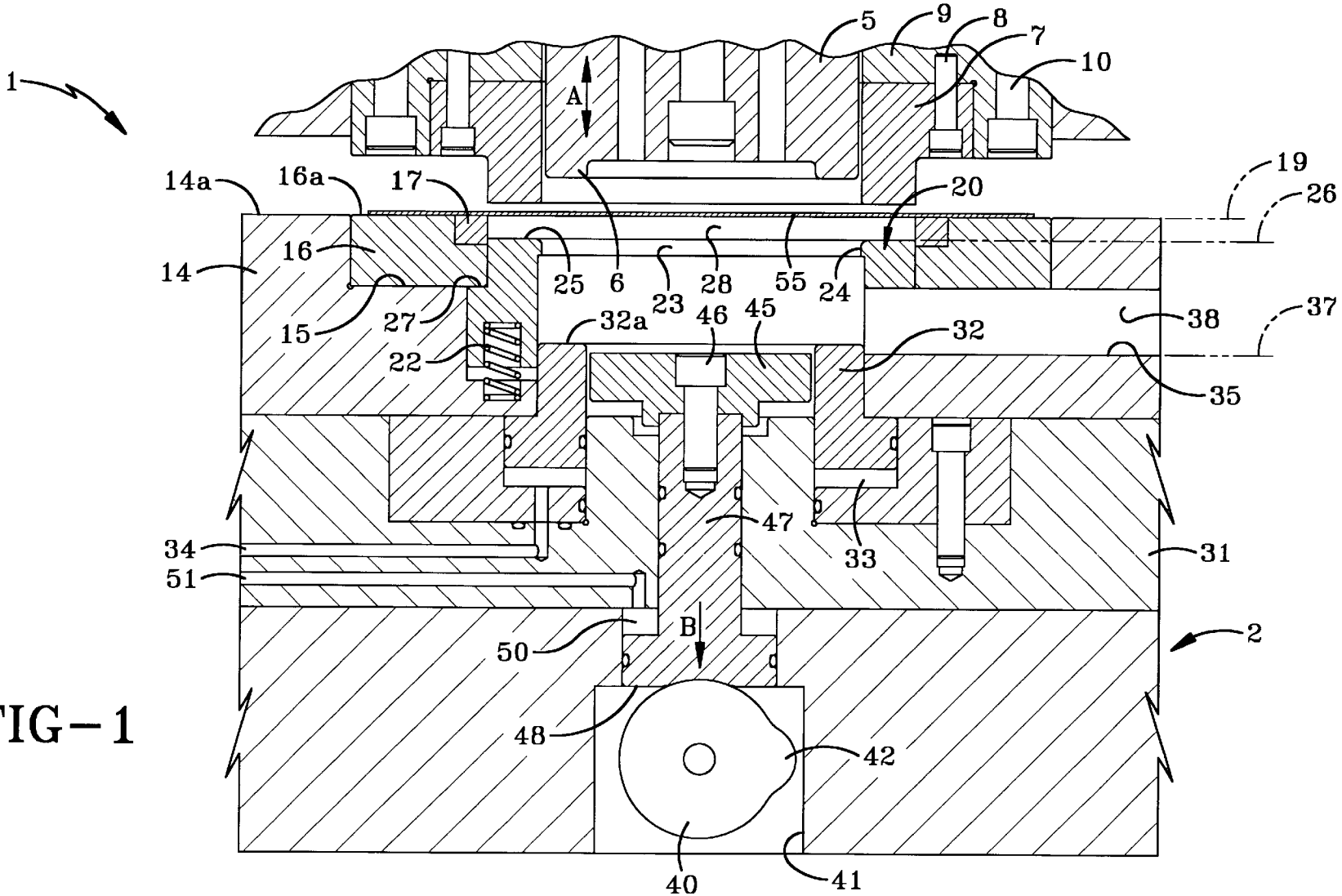
FIG. 1 is a diagrammatic fragmentary sectional view of portions of the press and associated apparatus for carrying out the method of the present invention for forming the container component, at the start of the forming operation.
Figure 2:
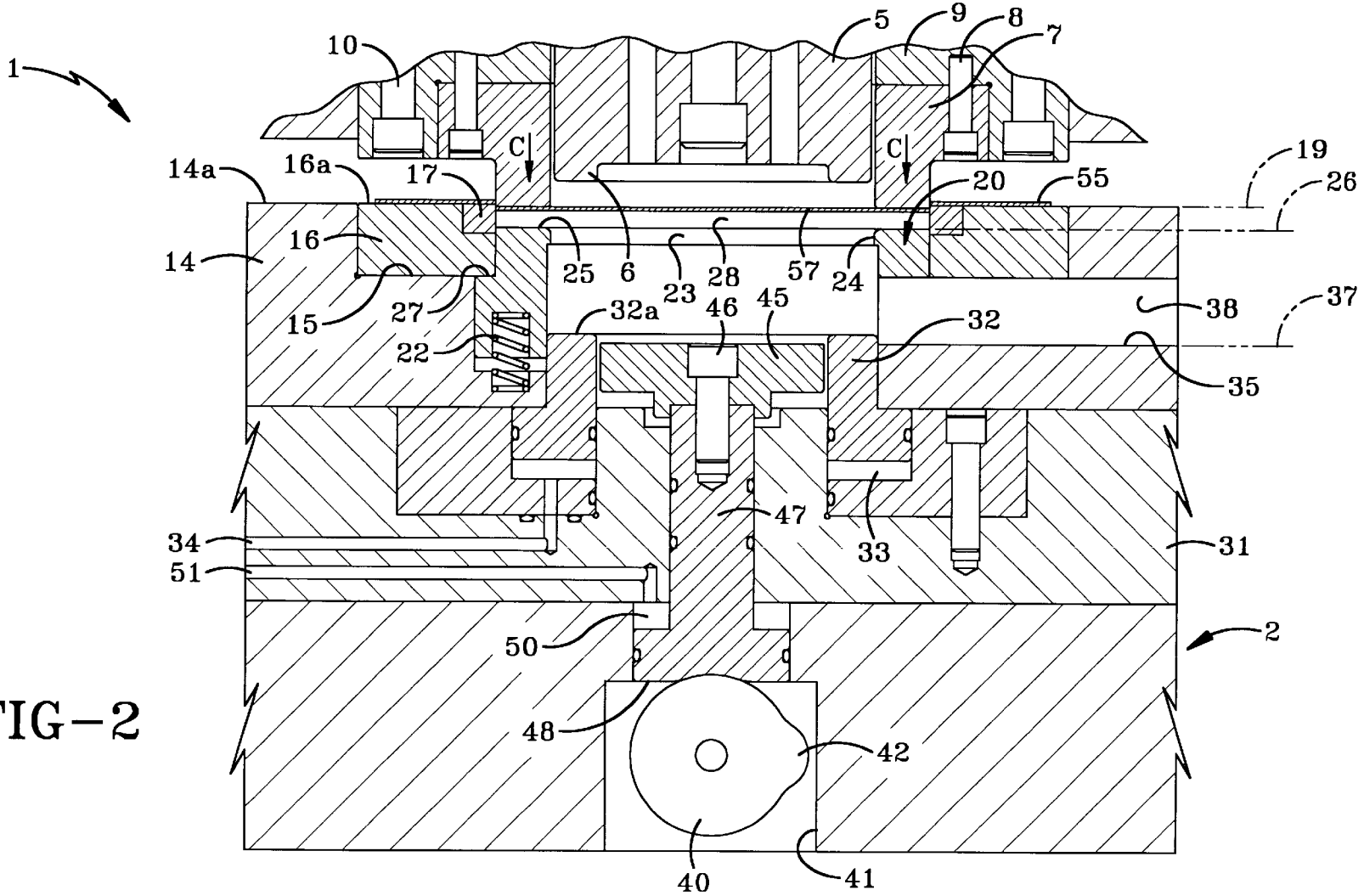
FIG. 2 is a sectional view similar to FIG. 1 showing cutting of a disk blank from the sheet material on the fixed stock plate.

The method and apparatus of the present invention preferably is utilized in conjunction with a double acting press. The press is indicated generally at 1, and includes inner and outer rams (not shown) movable toward and away from a generally fixed base 2. The complete press will not be described in detail since such double acting presses are well known in the art and are exemplified in U.S. Pat. No. 5,626,048, the contents of which are incorporated herein by reference.

A draw horn or draw punch 5 is mounted on the inner ram for vertical movement in the direction of arrow A and will include an outer downwardly projecting annular ring 6. An annular draw pad 7 is secured by bolts 8 to an annular mounting ring 9 which is operatively engaged with a lowermost piston of a piston assembly, such as shown in U.S. Pat. No. 5,626,048, by bolts 10. Ring 9 is mounted to and vertically movable by the outer ram through the piston assembly.

In accordance with one of the features of the invention, a stock plate 14 is immovably supported on base 2 and has an annular cutout 15 in which is seated a cut edge retainer ring 16 that holds a cut edge 17. The upper surface 14*a* of stock plate 14 lies in the same plane with the upper surface 16*a* of retainer ring 16 and defines a first level indicated by dot dash line 19. A blank and draw die indicated generally at 20, is mounted concentrically within stock plate 14 adjacent to and below cut edge 17, and is movably mounted, preferably by a plurality of circumferentially spaced compression coil springs 22. If desired, springs 22 could be replaced with pneumatic cylinders without affecting the manner of operation.

Blank and draw die 20 has a die opening 23 defined by an annular die forming radius edge 24. The horizontal top annular surface 25 of die 20 defines a second planar level indicated by dot dash line 26, when it is at its maximum upward position as shown in FIG. 1. An annular shoulder 27 of die 20 engages an outer edge of retainer ring 16 which limits the upward movement of die 20 to the second level. An annular opening 28 is formed by annular cut edge 17 and aligns with a die opening 23 of blank and draw die 20.

A reciprocally movable knockout ring 32 is mounted within a pneumatic chamber or cylinder 33 formed in a mounting ring 31 and is connected to a source of pressurized air through an air passage 34. When knockout ring 32 is at its maximum raised position as shown in FIG. 1, its top surface 32*a* will be slightly above or at the same level as the bottom surface 35 of a discharge opening 38 formed in stock plate 14. Discharge opening 38 can extend either in-line with the feed direction of strip material 55 or normal thereto without effecting the concept of the invention. Another air passage 36 is formed in stock plate 14 (FIG. 7) which aligns with discharge opening 38 for ejecting a formed container component from the press as discussed further below. Surface 35 forms a horizontal third planar level indicated by dot dash line 37.

In accordance with another of the features of the invention, a rotating cam 40 is located within a cutout 41 formed in base 2 and has a raised area 42 thereon. A bottom profiling or forming pad 45 is mounted by bolts 46 to the upper end of a inner die core 47. Lower end 48 of die core 47 is engaged with cam 40 and is mounted within a cylindrical chamber 50 formed in base 2. Chamber 50 is supplied with pressurized air through an air passage 51 for biasing die core 47 in a downwardly direction as shown by arrow B, into engagement with cam 40.

Figure 3:
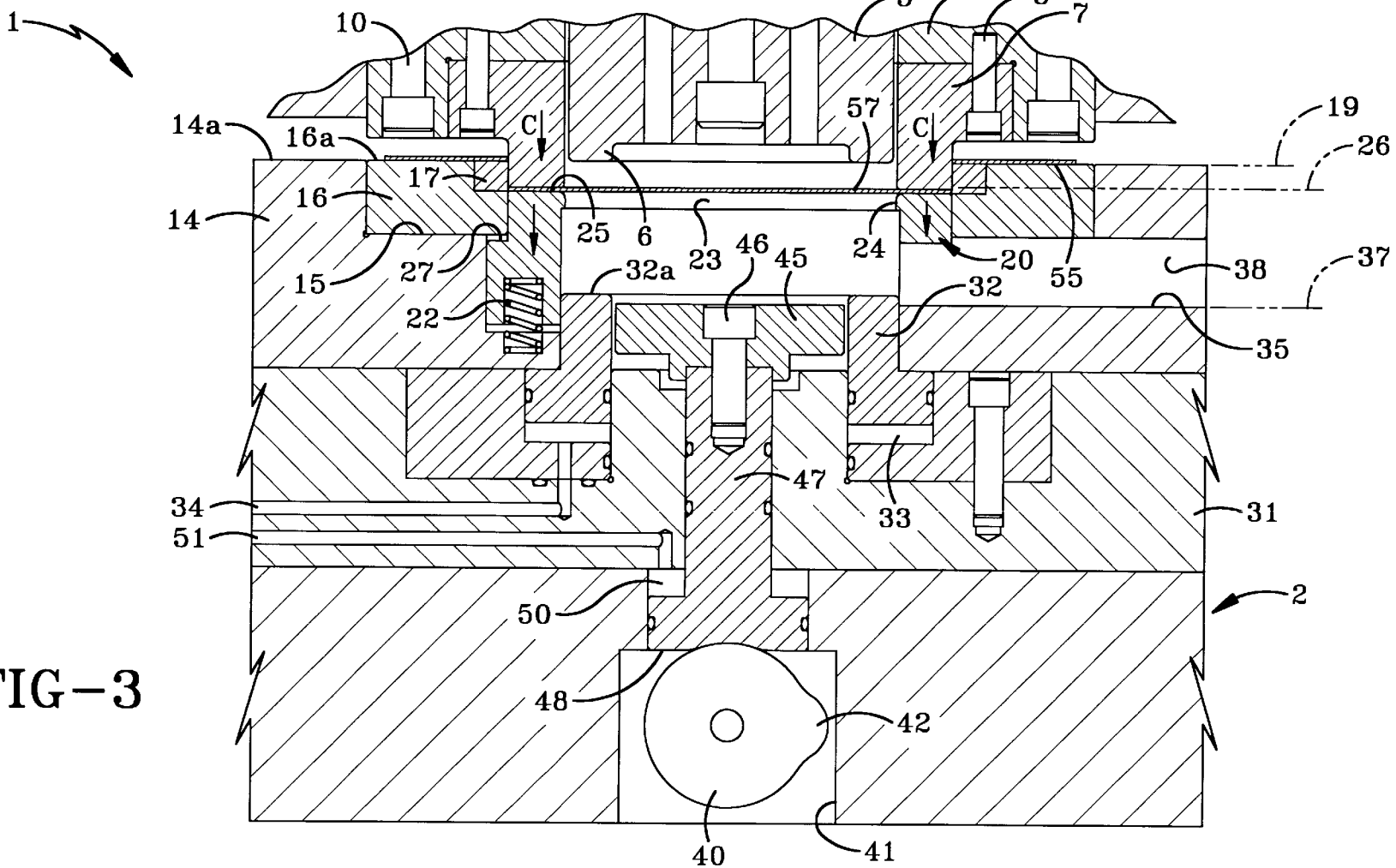
FIG. 3 is a sectional view similar to FIGS. 1 and 2 showing clamping of the blank disk between a draw pad and a lower blank and draw die at a second level.
Figure 4:
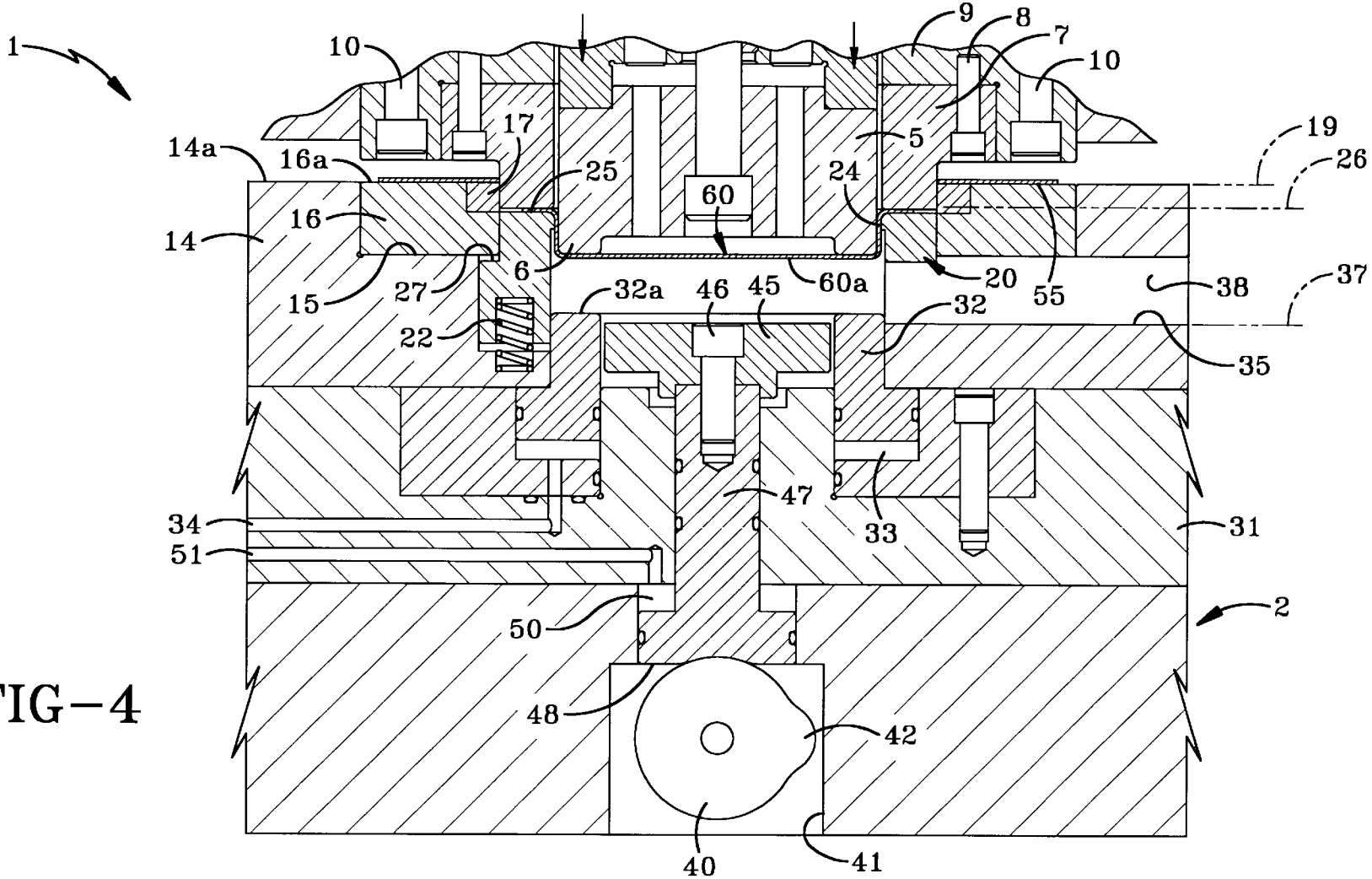
FIG. 4 is a view similar to FIGS. 1–3 showing the blank disk being partially formed into a shallow cup-shaped configuration by the advancing draw punch.
Figure 5:
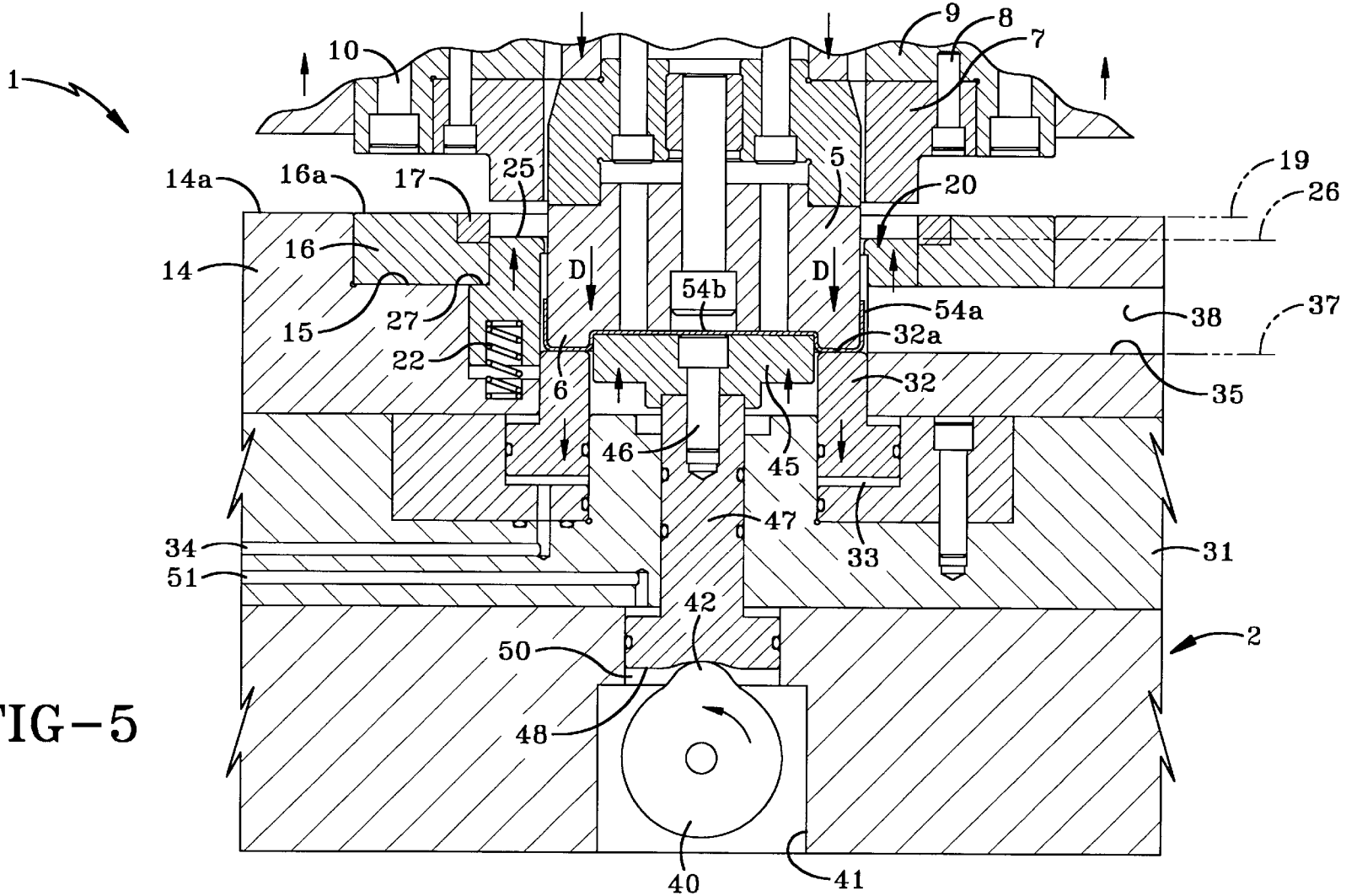
FIG. 5 is a view similar to FIGS. 1–4 showing the bottom wall of the cup-shaped blank being profiled by upward movement of a cam actuated bottom profile pad.
Figure 6:
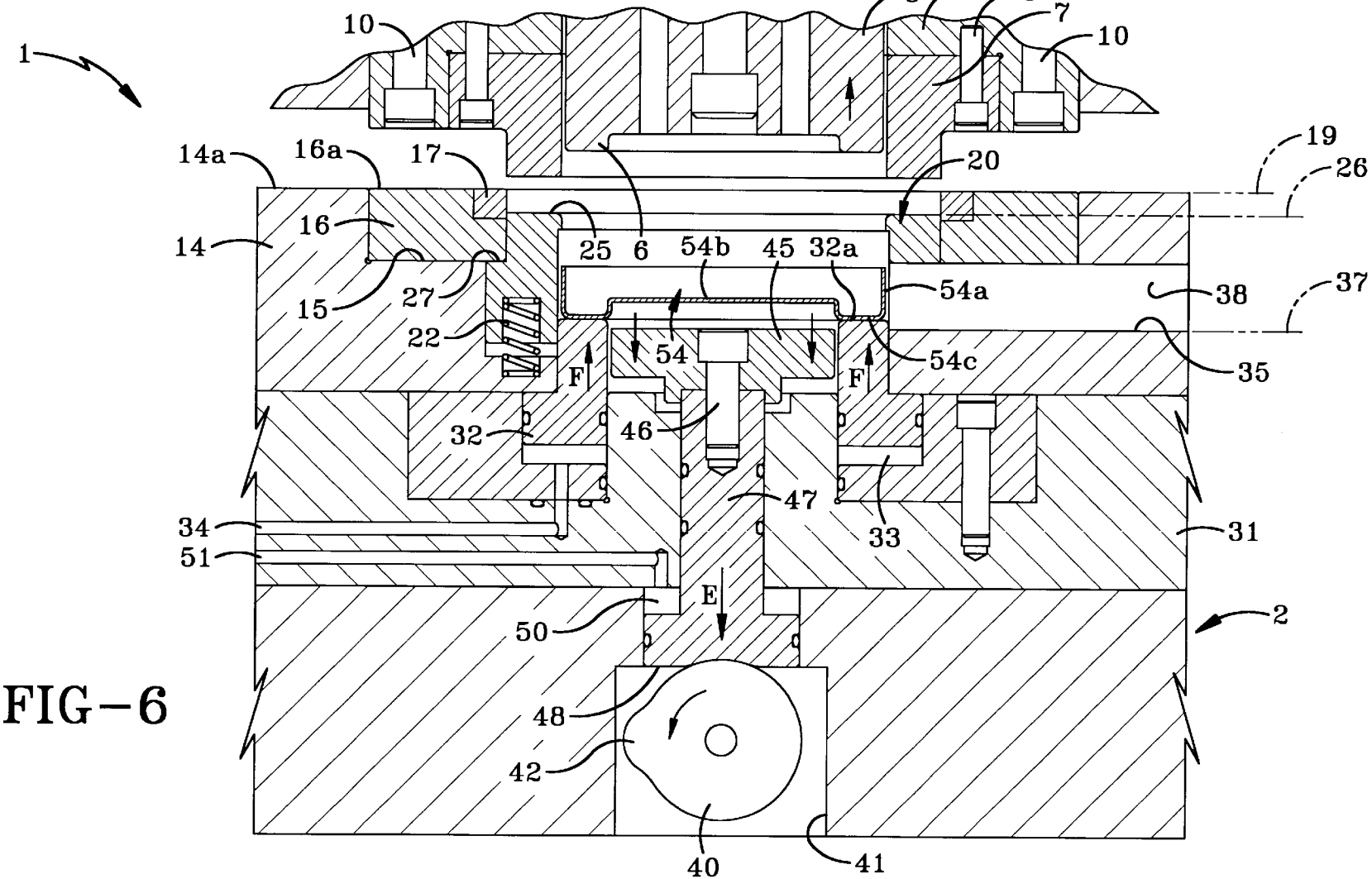
FIG. 6 is a view similar to FIGS. 1–5 showing the profiled cup being raised to the third level by a knockout ring.
Figure 7:
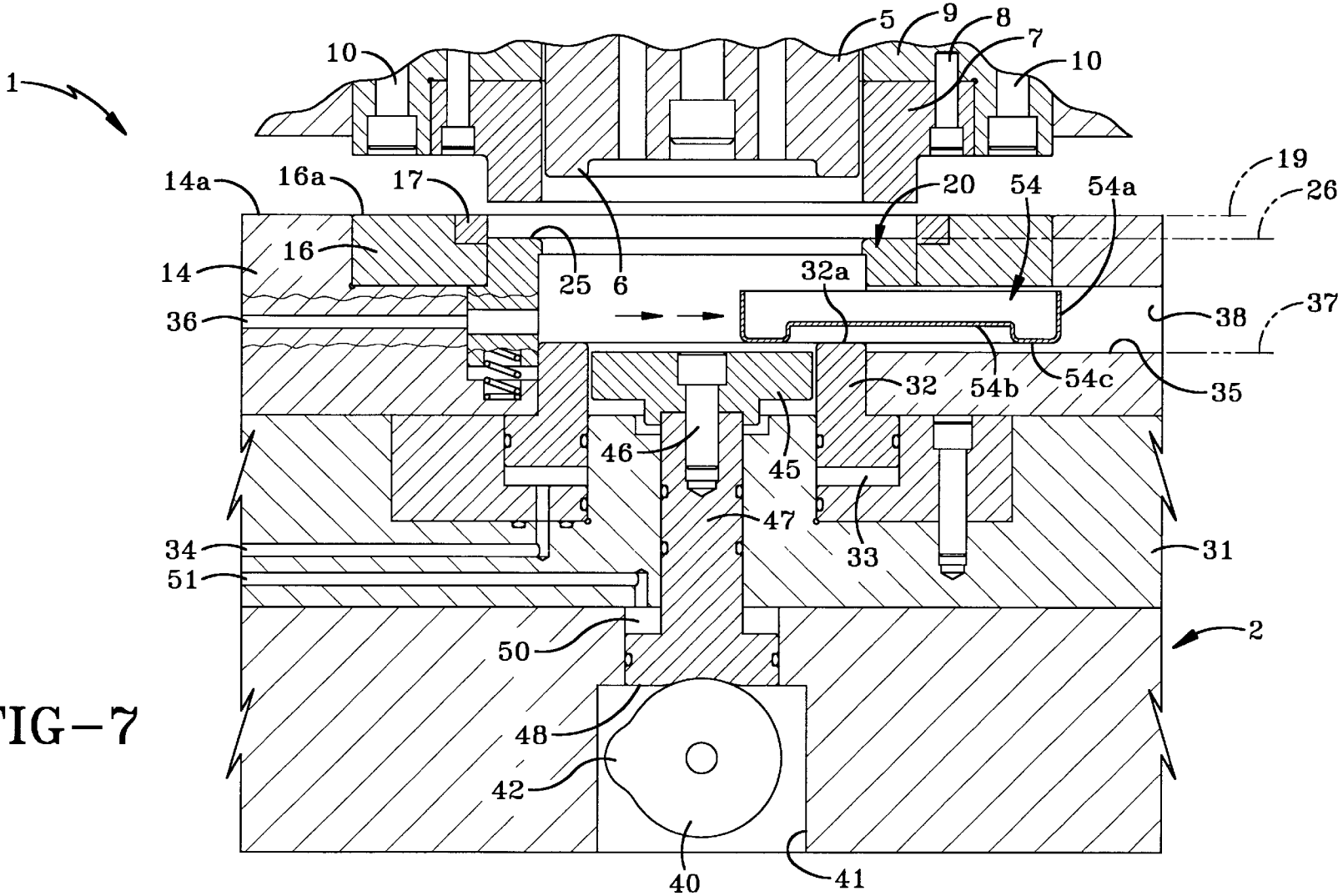
FIG. 7 is a modified view similar to FIGS. 1–6 showing the profiled cup being ejected from the press at the third level.
Figure 8:
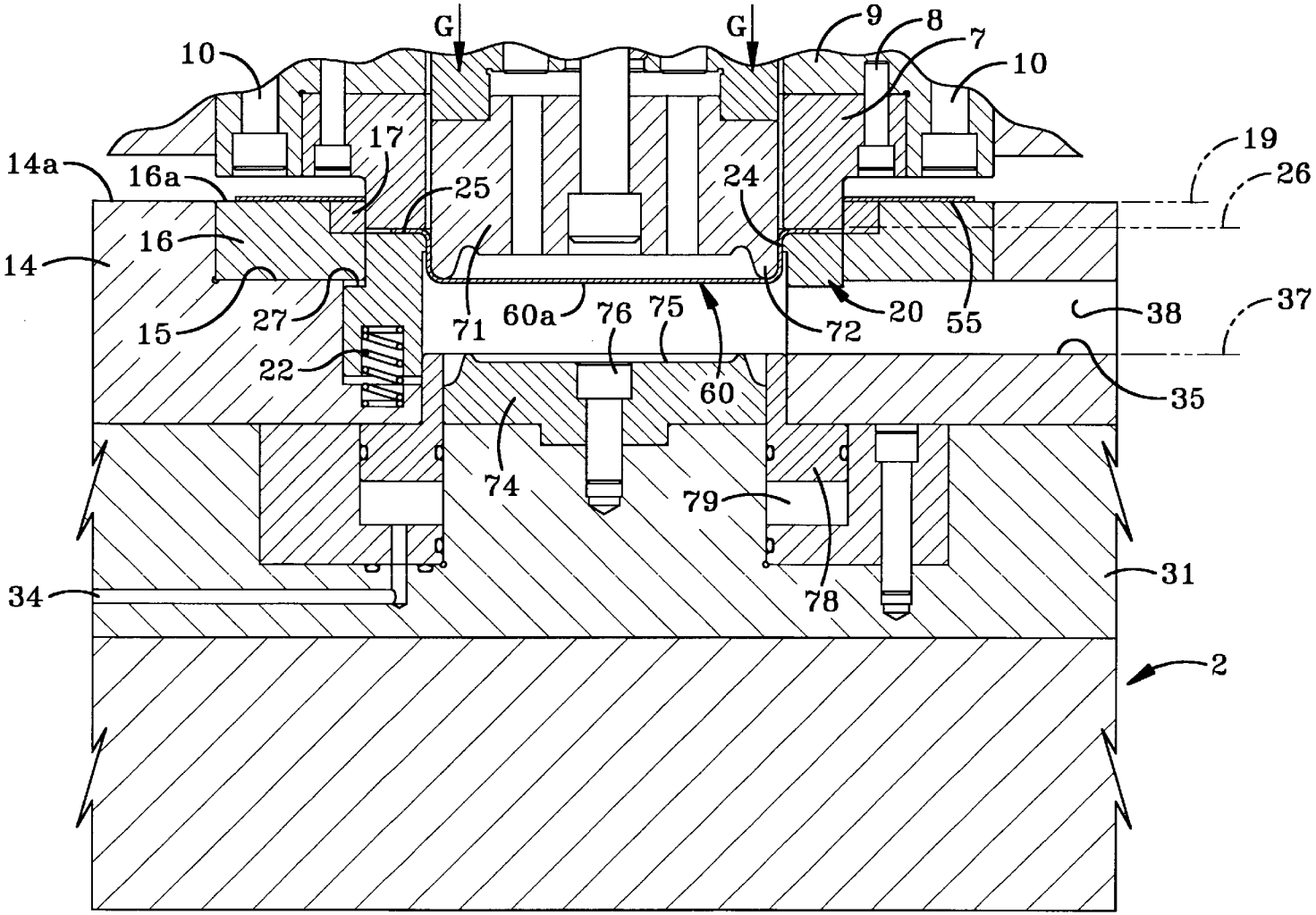
FIG. 8 is sectional view similar to FIG. 4 of a second embodiment showing the disk-shaped blank being formed into a shallow cup at the second level before being formed into an end shell.

The operation of press 1 and the apparatus or tooling thereof, is shown in FIGS. 1–7 forming a container body 54 which is shown particularly in FIGS. 6 and 7. Body 54 has a cylindrical sidewall 54*a* and a profiled bottom wall 54*b*. A strip of sheet material, generally a very light gauge aluminum 55, is fed into the press along upper surfaces 14*a* and 16*a* at first level 19 (FIG. 1). Draw pad 7 is moved downwardly in the direction of arrows C (FIG. 2) by the outer ram and severs a disk-shaped blank 57 from strip material 55 by cut edge 17. Draw pad 7 continues to move downwardly and clamps disk blank 57 against annular top surface 25 of blank and draw die 20 at second level 26 as shown in FIG. 3.

Draw punch 5 advances downwardly and draws a shallow cup-shaped blank 60 as the sheet material is drawn around die forming radius 24 while draw pad 7 continues to supply a releasable clamping pressure against the disk blank and clamping surface 25 of die 20. As cup-shaped blank 60 is moved downwardly by draw punch 5 (FIG. 5) (arrow D), cam 40 is rotated from the position of FIG. 1 to that of FIG. 5 wherein raised camming surface 42 moves die core 47 upwardly with die core pad 45 engaging bottom wall 60*a* of blank 60 forming recessed bottom 54*b* of cup 54. This upward movement of die pad 45 into engagement with the bottom wall of cup blank 60 occurs adjacent third level 37 and avoids the heretofore movement of the cup-shaped blank below this third level or discharge opening, and then returning the formed body to an upper level before discharge. This assists in increasing the production speed of the press.

Continued rotation of cam 40 permits die core 47 to move downwardly in the direction or arrow E (FIG. 6) by the force of the pressurized air entering through air passage 51. Generally simultaneously therewith pressurized air is injected through air passage 34 and moves knockout ring 32 upwardly as shown by arrows F, to ensure that the lowermost outer annular surface 54*c* of cup 54 is at or slightly above discharge level 37. Pressurized air is ejected through air passage 36 against cup sidewall 54*a* and ejects the cup through discharge passage 38 for depositing it onto a conveyor or into a hopper or other transfer mechanism.

One of the important advantages achieved by the apparatus and method discussed above and shown in FIGS. 1–7, is that stock plate 14, including cut edge retainer ring 16, are in a fixed position. This avoids reciprocal movement of the incoming sheet material and of the scrap web at each stroke of the press which heretofore slows the press speed and subjects the press to possible jamming by the heretofore continual reciprocal movement of the flexible strip and scrap web. This reciprocal movement is completely avoided by the fixed stock plate enabling the blank disk to be cut at a first level prior to it being clamped at the lower second level. The blank is then drawn into the shallow cup-shaped blank for bottom profiling by the upward movement of the profile cam at the third level. These procedures assist in increasing the press speed by limiting the travel of the incoming sheet material and scrap web, by limiting the travel of the cup-shaped blank before profiling of the bottom wall and by limiting the distance that the profiled cup has to move prior to being ejected from the die.

Figure 9:
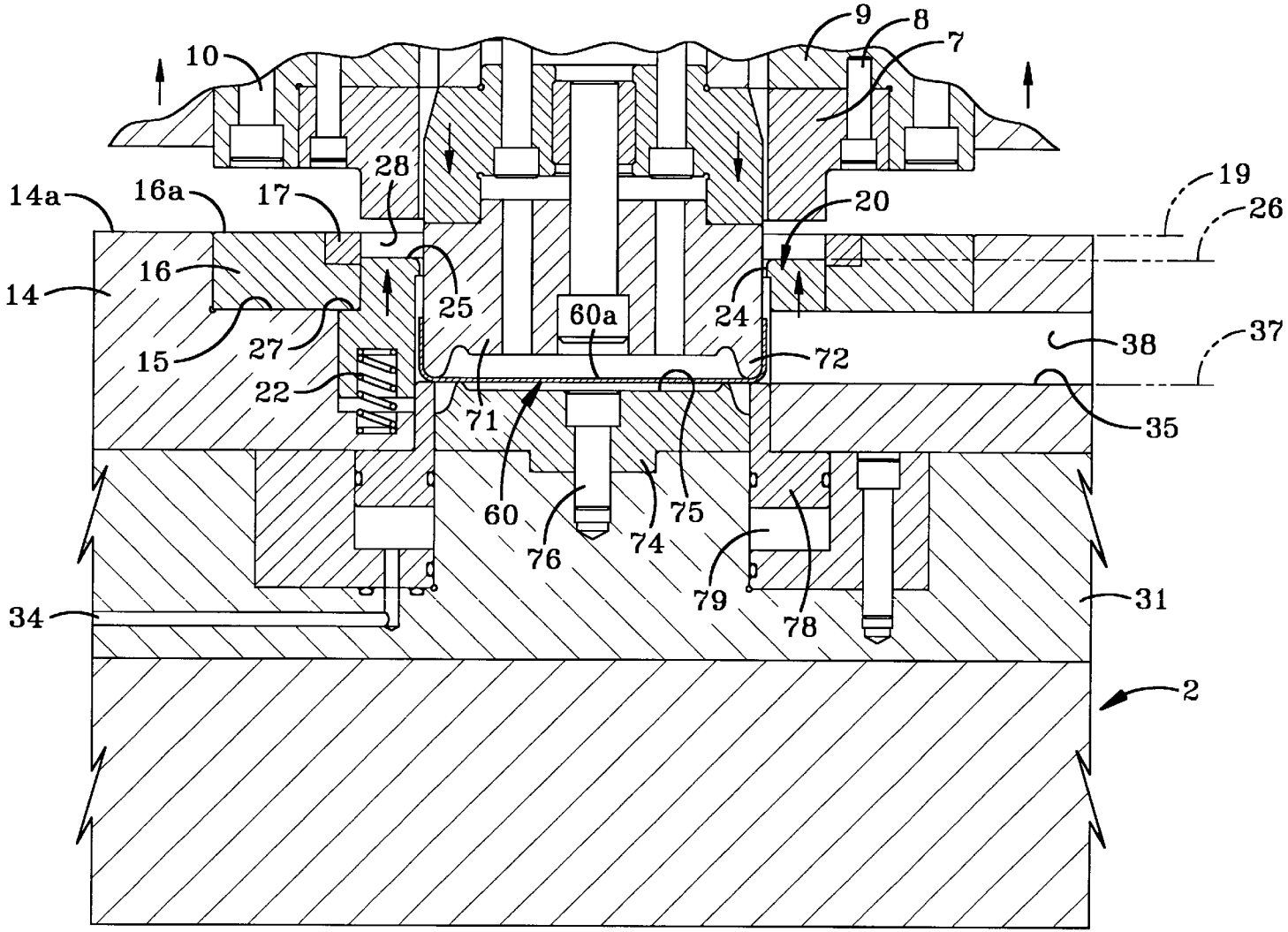
FIG. 9 is a sectional view similar to FIG. 8 showing the cup-shaped blank moving downwardly into contact with the bottom profile pad at the third level.

A modified embodiment of this method and apparatus is shown in FIGS. 8–12 and is shown in forming an end panel or shell 70 which provides an end closure or lid for many types of containers. Again, the blanking of the disk shaped blank 57 is achieved in the same manner as shown and described in FIGS. 1–3. A modified draw horn 71 moves downwardly in the direction of arrows G (FIG. 8) and has a rounded annular outer nose 72 which draws the disk shaped blank over the die forming radius 24 into the shallow cup-shaped blank 60 as shown in FIG. 9.

Figure 10:
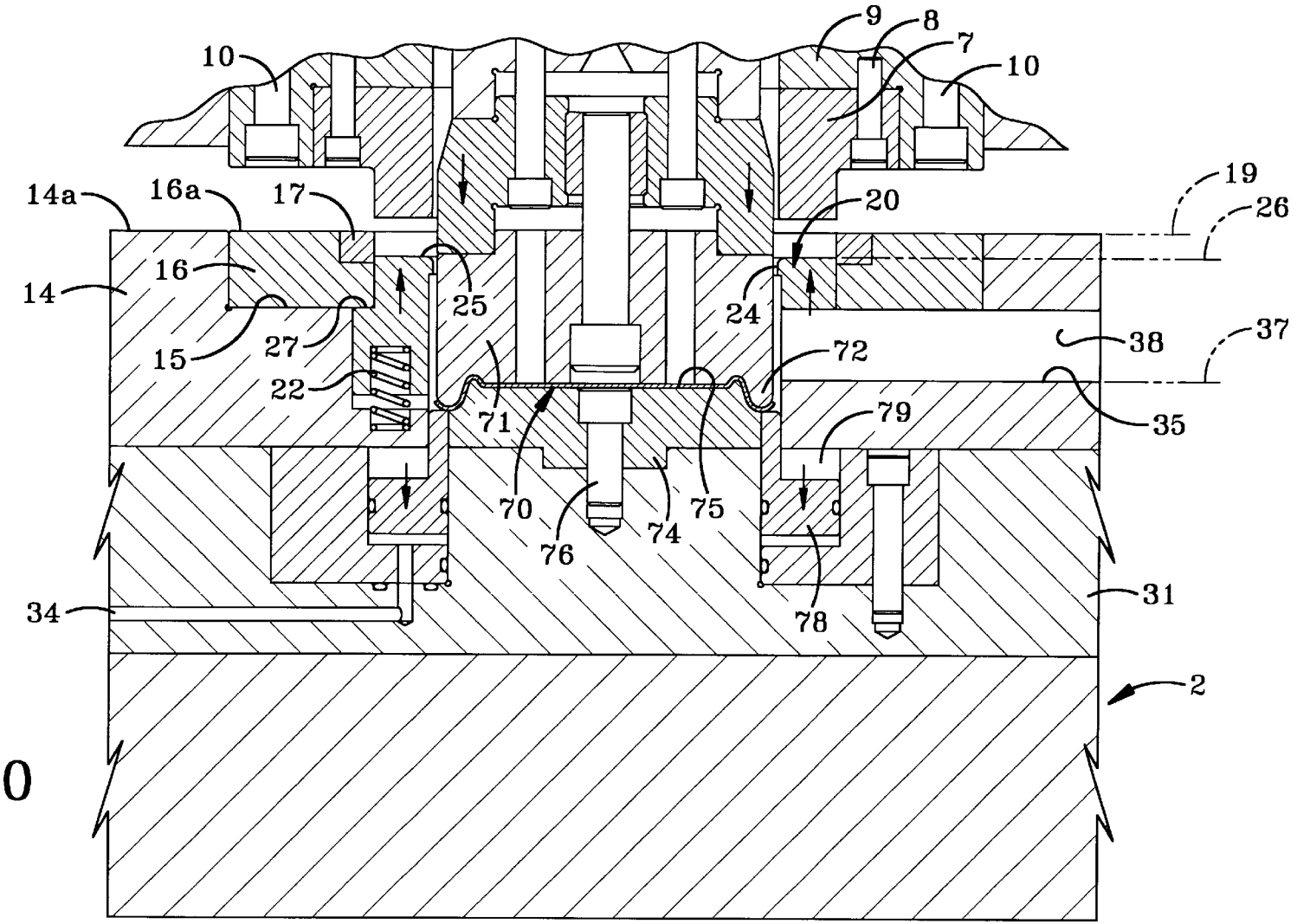
FIG. 10 is a view similar to FIGS. 8 and 9 showing the cup being formed into the end shell configuration adjacent the third level by the profile pad.
Figure 11:
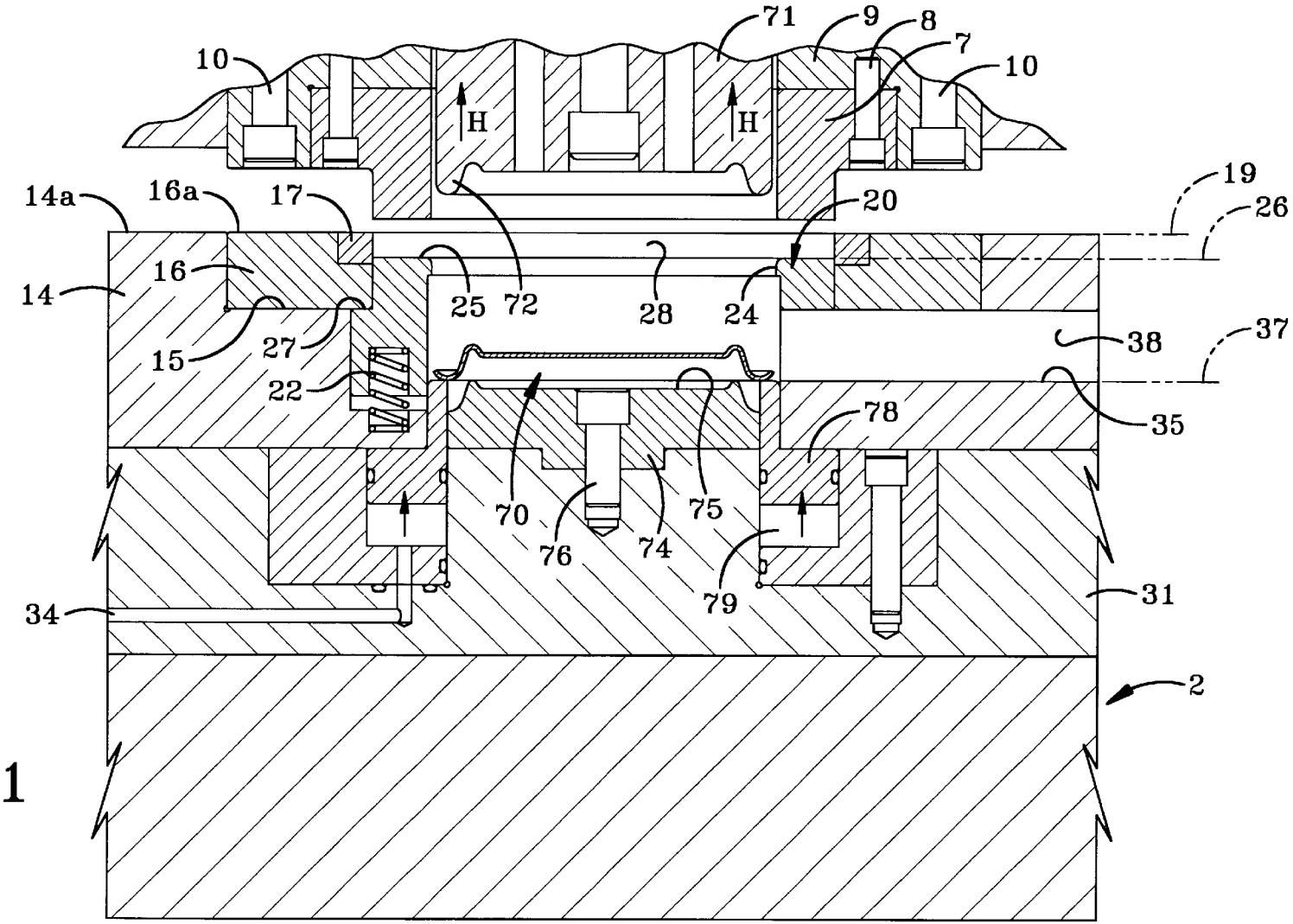
FIG. 11 is a view similar to FIGS. 8–10 showing the formed end shell being moved upwardly toward the third level by the knockout ring.
Figure 12:
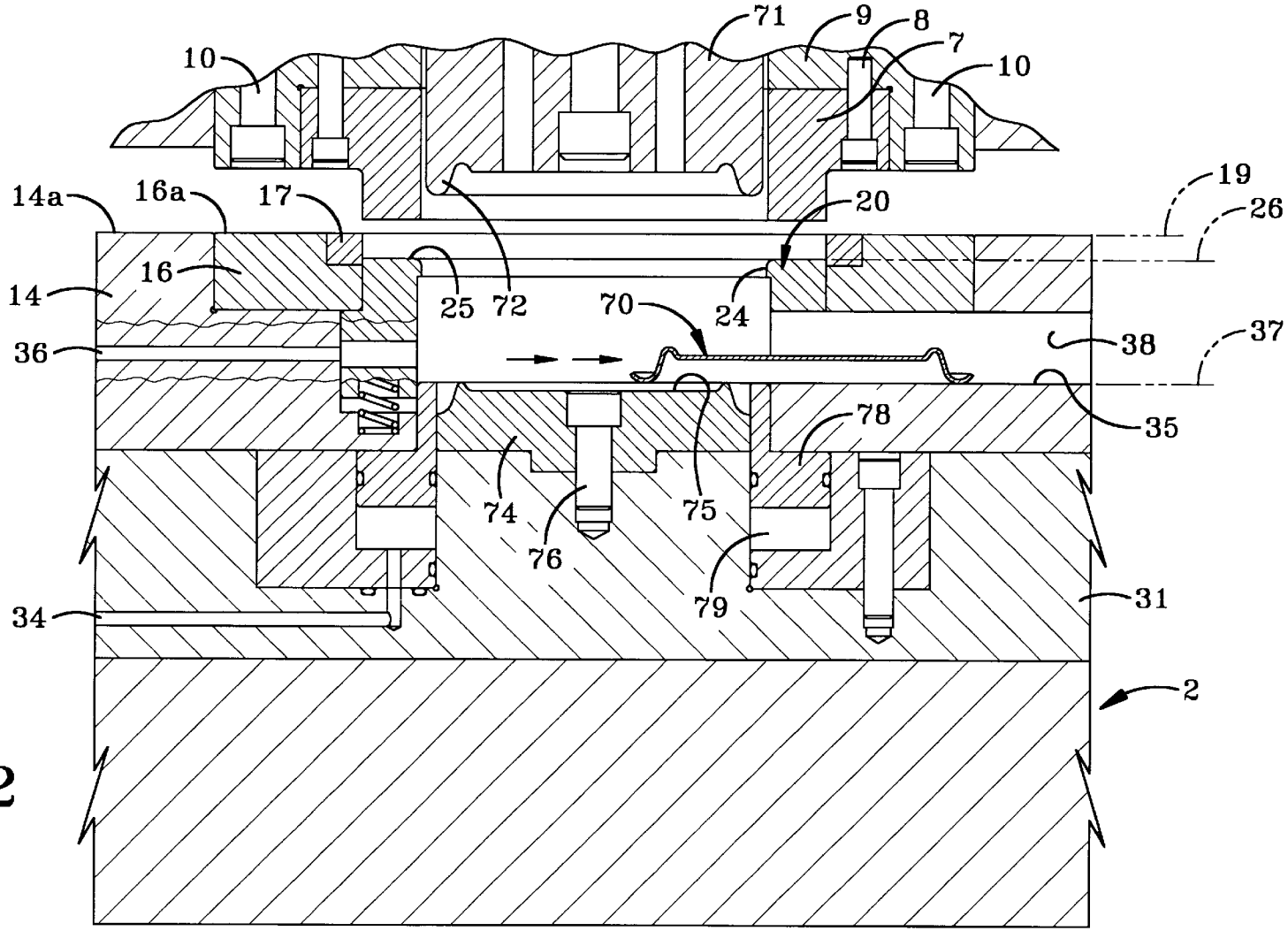
FIG. 12 is view similar to FIGS. 8–11 showing the end shell being ejected from the press at the third level.

In this modified apparatus, a fixed die pad 74 has a contoured top surface 75 and is mounted in a fixed position on base 2 by bolts 76. Thus, the continued downward movement of draw horn 71 will form end shell 70 by clamping engagement of the draw horn bottom surface including outer nose 72, against profile surface 75 of pad 74. Draw horn nose 72 also will move a knockout ring 78 downwardly from the position of FIG. 9 to that of FIG. 10, overcoming the pressurized air contained within knockout ring cylinder 79, until draw horn 71 has bottomed out against profile pad 74 imparting the desired configuration into cup-shaped blank 60 forming end panel 70 as shown in FIG. 10. Draw horn 71 then moves upwardly in the direction of arrows H (FIG. 11) with knockout ring 78 lifting end shell 70 off the profile pad and to third level 37 where it is then ejected through discharge opening 38 by pressurized air entering through air passage 36.

Again, the use of a fixed stock plate at the first level for blanking of the disk-shaped blank which is then carried to a second level before being clamped against the draw pad ring avoids the heretofore problems which occur with a movable stock plate and movable sheet material and scrap web enabling the speed of production to be increased.

Accordingly, the improved method and apparatus for forming a container component is simplified, provides an effective, safe, inexpensive, and efficient device and method which achieves all the enumerated objectives, provides for eliminating difficulties encountered with prior devices and methods, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the method and apparatus for forming a container component is constructed and used, the characteristics of the construction, and the advantageous new and useful results obtained; the new and useful structures, devices, elements, arrangements, parts, method steps and combinations are set forth in the appended claims.

What is claimed is:

1. A method of forming a container component from a strip of metal material fed into a press including the steps of:

providing the press with a fixed stock plate defining a first level;

feeding the strip material onto the fixed stock plate of the press at the first level;

cutting a blank from the strip material at said first level by advancing a draw pad;

clamping the blank between the draw pad and a blank and draw die at a second level;

forming a shallow cup from the blank by advancing a punch assembly beyond the second level toward a third level and drawing the blank around the blank and draw die while releasing the clamping pressure on said blank exerted by the draw pad;

profiling a bottom wall of the cup adjacent the third level to form the container component by continuing to advance the punch assembly through the die to adjacent the third level; and removing the container component from the press at the third level.

2. The method defined in claim 1 wherein the strip material is free of clamping pressure when performing the step of cutting a blank from said strip material.

3. The method defined in claim 1 including the step of moving a bottom profiling pad into contact with the bottom wall of the cup to profile said bottom wall when said cup is adjacent the third level.

4. The method defined in claim 3 including the step of moving a rotating cam into contact with the bottom profiling pad to move said pad into contact with the bottom wall of the cup.

5. The method defined in claim 1 including the step of providing a bottom profiling pad in a fixed position adjacent the third level for profiling the bottom wall of the cup.

6. The method defined in claim 1 including the step of providing a knockout ring surrounding a bottom profiling pad for raising the container component to adjacent the third level after the step of profiling the bottom wall.

7. The method defined in claim 1 including the step of applying a stream of high pressure air against the container component to remove said component from the press.

8. The method defined in claim 1 including the step of movably mounting the blank and draw die adjacent the second level.

9. The method defined in claim 1 wherein the container component is an end shell for a container body.

10. Apparatus for forming a container component from sheet metal material in a press including:

a base;

a stock plate immovably mounted on the base and defining a first level;

a cut edge carried by the base at said first level for forming a blank disk from the sheet material;

a blank and draw die mounted on the base and having a top clamping surface defining a second level;

a discharge opening defining a third level below the clamping surface of the blank and draw die;

a profile pad mounted on the base having a top profile surface generally adjacent with the third level;

a draw pad reciprocally mounted for releasably clamping the blank disk against the clamping surface of the blank and draw die; and a draw punch reciprocally movably mounted within the draw pad for moving the blank disk through the blank and draw die as the draw pad releases clamping pressure against the blank disk to form a shallow cup-shaped blank and to move the cup-shaped blank into forming engagement with the profile pad to form the container component in a single stroke.

11. The apparatus defined in claim 10 in which a rotatable cam is engageable with the profile pad for moving said pad into forming engagement with the cup-shaped blank.

12. The apparatus defined in claim 10 in which the profile pad is fixedly mounted on the base.

13. The apparatus defined in claim 10 in which the blank and draw die is movably mounted on the base.

14. The apparatus defined in claim 10 in which an air passage is located adjacent the third level for directing a stream of air against the formed container component to eject said component from the press.

15. The apparatus defined in claim 10 in which the draw pad and profile pad have mating contoured surfaces for profiling a bottom wall of the cup-shaped blank.

16. The apparatus defined in claim 10 in which a knockout ring is concentrically mounted about the profile pad for moving the container component to adjacent the third level.

17. The apparatus defined in claim 10 in which a discharge opening is formed in the base and extends in-line with the feed direction of the sheet material into the press.

* * * * *